US010018395B2

(12) United States Patent
Boyd

(10) Patent No.: US 10,018,395 B2
(45) Date of Patent: Jul. 10, 2018

(54) BEVERAGE COOLING OR HEATING DEVICE

(71) Applicant: Darlene S. Boyd, Naples, FL (US)

(72) Inventor: Darlene S. Boyd, Naples, FL (US)

( * ) Notice: Subject to any disclaimer, the term of this patent is extended or adjusted under 35 U.S.C. 154(b) by 34 days.

(21) Appl. No.: 15/272,897

(22) Filed: Sep. 22, 2016

(65) Prior Publication Data

US 2017/0082343 A1 Mar. 23, 2017

Related U.S. Application Data

(60) Provisional application No. 62/221,954, filed on Sep. 22, 2015.

(51) Int. Cl.
*F25D 5/02* (2006.01)

(52) U.S. Cl.
CPC ..... *F25D 5/02* (2013.01)

(58) Field of Classification Search
CPC ..... F25D 5/02; F25D 31/003
USPC ..... 62/4
See application file for complete search history.

(56) References Cited

U.S. PATENT DOCUMENTS 2,898,744 A 8/1959 Robbins
3,023,587 A * 3/1962 Robbins ..... F25D 5/02 126/263.07
3,147,888 A 9/1964 Mooney
3,950,158 A * 4/1976 Gossett ..... F24J 1/00 206/219
4,325,230 A 4/1982 Driscoll et al.
4,554,189 A 11/1985 Marshall
5,357,761 A 10/1994 Schauer
5,603,219 A 2/1997 Kolb
5,723,002 A 3/1998 Delk et al.
5,799,501 A 9/1998 Leonard et al.
6,233,945 B1 5/2001 Kohout
6,564,558 B1 5/2003 Seymour
6,966,252 B2 * 11/2005 Hamiel ..... A23L 2/60 426/112
2005/0007870 A1 * 1/2005 Faraldi ..... B01F 11/0071 366/130
2005/0210911 A1 9/2005 Dyrbye et al.
2008/0016882 A1 * 1/2008 Neuweiler ..... F25D 5/02 62/4
2008/0196434 A1 * 8/2008 Spratley ..... F25D 3/08 62/293
2013/0047634 A1 2/2013 Harsh et al.
2014/0245527 A1 * 9/2014 Douglas ..... A41D 13/0051 2/459

(Continued)

*Primary Examiner* — Cassey D Bauer
(74) *Attorney, Agent, or Firm* — Vorys, Sater, Seymour and Pease LLP; Rex W. Miller, III

(57) ABSTRACT

A beverage cooling or heating device includes a sealed housing, a first chamber within the housing that contains a thermal agent, a second chamber within the housing that contains an activating agent, for endothermically or exothermically reacting with the thermal agent, and a barrier between the first chamber and the second chamber, wherein the barrier is configured to keep the thermal agent separate from the activating agent, and is further configured to be ruptured upon activation of the device such that the thermal agent and activating agent come into contact with and react with each other. The thermal agent may be a cooling agent, such as urea, and the activating agent may be water. The thermal agent may alternatively be a heating agent.

19 Claims, 2 Drawing Sheets

(56) References Cited

U.S. PATENT DOCUMENTS

2016/0122115 A1* 5/2016 Peppou ..... B01D 53/28
62/4

* cited by examiner

BEVERAGE COOLING OR HEATING DEVICE

CROSS-REFERENCE TO RELATED APPLICATION

This application claims priority to U.S. Provisional Patent Application No. 62/221,954 filed on Sep. 22, 2015, the disclosure of which is incorporated by reference in its entirety.

BACKGROUND AND SUMMARY

The present disclosure relates to a beverage cooling or heating device, and more particularly to a single use device configured to be placed within a beverage to cool or heat the beverage within a container.

The options for providing a cold beverage have been relatively limited. As is well known, ice cubes may be added to a beverage to reduce its temperature When the ice cubes melt, the resulting water released by the ice cubes dilutes the beverage which may adversely affect the taste and appearance of the beverage. In addition, ice cubes are typically added to a beverage at the location where the beverage is prepared. When a beverage is prepared some distance from the point of consumption, the time spent transporting the beverage from the preparation location to the consumption location results in increased melting of the ice cubes and further dilution of the beverage. Moreover, ice cubes must be stored in a freezer or similar cold storage until use to prevent premature melting, therefore ice cubes are rarely available at the point of consumption of the beverage.

One attempt to overcome the problem with ice cubes and dilution of beverages has been the use of re-freezeable ice cubes. Re-freezeable ice cubes are well known and typically have a plastic casing filled with water or another substance with a similar freezing temperature. The re-freezeable ice cubes may be frozen and placed into a beverage in the same manner as a conventional ice cube, but because the ice is encased the problems of dilution are solved. Re-freezeable ice cubes however still suffer from the problem of only being available at the point of preparation of the beverage because they must be maintained in a freezer prior to use. When beverages are transported significant distances, such as is common at some resorts, the re-freezable ice cubes may be ineffective to cool the beverage at the point of consumption.

Similar problems exists with respect to hot beverages. A beverage may be heated at the point of preparation, but begins to cool while being transported to the point of consumption where this is little or no capability to heat or reheat the beverage.

In view of the limitations of previously available products, there remains a need for a beverage cooling or heating device that is capable of cooling or heating a beverage at the point of consumption without diluting the beverage. There also remains a need for a beverage cooling or heating device that is configured for use with standard drinking glasses, including wine glasses, while maintaining a pleasing aesthetic during use.

Presently disclosed is a device that includes a sealed housing configured to be placed into a beverage, a first chamber within the housing that contains a thermal agent, a second chamber within the housing that contains an activating agent for endothermically or exothermically reacting with the thermal agent, and a barrier between the first chamber and the second chamber. The barrier is configured to keep the thermal agent separate from the activating agent, and is further configured to be ruptured upon activation of the device such that the thermal agent and activating agent come into contact with and react with each other.

In some embodiments, the thermal agent is a cooling agent. In some embodiments, the cooling agent is urea and the activating agent is water.

In various embodiments, the housing includes a low density polyethylene, a medium density polyethylene, or a high density polyethylene. In some embodiments, the housing includes a plant based biopolymer.

In some embodiments, the device includes a flavor coating on an exterior surface of the housing, wherein the flavor coating is configured to dissolve in a beverage during use.

In some embodiments, the device includes a coloring agent within the sealed housing, wherein the coloring agent is configured to provide a visual indication in the event of a leak in the sealed housing.

In some embodiments, the device includes a taste additive disposed within the sealed housing, wherein the taste additive is configured to provide a taste indication in the event of a leak in the sealed housing.

In some embodiments, the second chamber is within the first chamber. In some embodiments, the barrier is secured to an interior surface of the housing, and is configured to be ruptured when the housing is flexed. In some embodiments, the barrier is a second chamber housing and is configured to be ruptured when the housing is squeezed.

In some embodiments, the sealed housing is configured to expand upon activation of the thermal agent and the activating agent.

In some embodiments, prior to activation, the sealed housing has a thickness of no greater than 0.25 inches in at least one dimension.

In some embodiments, the device includes a container attachment device secured to the housing and configured to affix the device to the rim of a glass or larger container.

In some embodiments, the thermal agent is a heating agent. In some embodiments, the heating agent is a supersaturated solution of sodium acetate.

BRIEF DESCRIPTION OF DRAWINGS

Reference is made to the accompanying drawings in which particular embodiments are illustrated as described in more detail in the description below, in which.

DETAILED DESCRIPTION OF THE DRAWINGS

Embodiments of the disclosed subject matter relate to a device for cooling or heating a beverage in a drinking container. Referring generally to FIGS. 1-5, embodiments of a beverage cooling or heating device are illustrated to highlight various aspects of the presently disclosed invention. As further explained below, the beverage cooling or heating device contains thermal agent, and an activating agent. The thermal agent and activating agent may be selected, to provide a cooling or heating effect.

Figure 1:
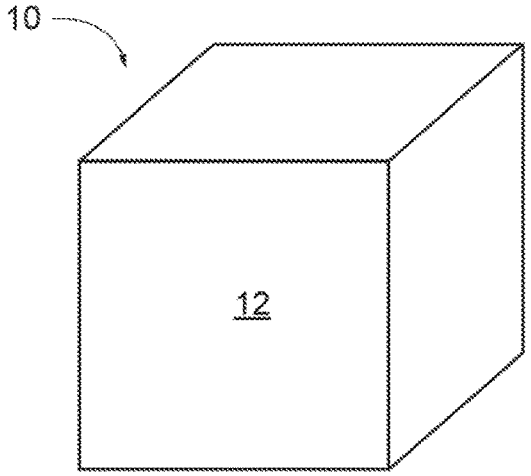
FIG. 1 is a perspective view of a beverage cooling device.

Referring to FIG. 1, a beverage cooling device 10 is illustrated having a generally cube shaped configuration. The beverage cooling device 10 is configured to be placed in a beverage within a beverage container, in a similar manner to an ice cube. The beverage cooling device 10 functions to cool the beverage as explained in more detail below. The beverage cooling device 10 may be a cube as illustrated. In other embodiments, the beverage cooling device 10 may be configured in other shapes for either performance or aesthetic reasons. For example, the beverage cooling device may be shaped to increase the ratio of surface area to volume in order to increase the cooling rate when the device is placed into a drink. Alternatively, the beverage cooling device may be shaped to decrease the ratio of surface area to volume in order to reduce the cooling rate and allow the beverage cooling device to maintain the temperature of the drink for a longer period of time. In yet other embodiments, the beverage cooling device may be shaped to resemble any variety of objects to provide a unique appearance for the beverage cooling device.

The beverage cooling device 10 has a housing 12. The housing 12 provide an outer casing for the beverage cooling device and defines an exterior and interior of the beverage cooling device and is sealed to prevent leakage of the contents of the housing into a beverage. In some embodiments, at least a portion of the housing 12 is flexible to permit activation of the beverage cooling device as described below. In one embodiment, the housing 12 is formed of a low density polyethylene. Polyethylene may be formed into a variety of shapes and may be formed to provide the desired geometry of the beverage cooling device, including flexible and/or rigid portion as may be desired. Moreover, polyethylene may be compatible with the intended use of the beverage cooling device which comes into contact with the beverage to be consumed. In some embodiments, the polyethylene may be formed from petroleum. Alternatively the polyethylene may be formed from biological material, such as corn, sugar beets or sugar cane. In some embodiments, a medium or high density polyethylene may be used to provide greater rigidity to the housing. In yet other embodiments, the housing 12 may be formed of a plant based biopolymer. In each embodiment, the housing is compatible with use in a consumable product and may be designed to avoid affecting the taste or odor of the beverage in which it is used. As such, the housing may be characterized as tasteless, odorless and non-toxic.

Figure 2:
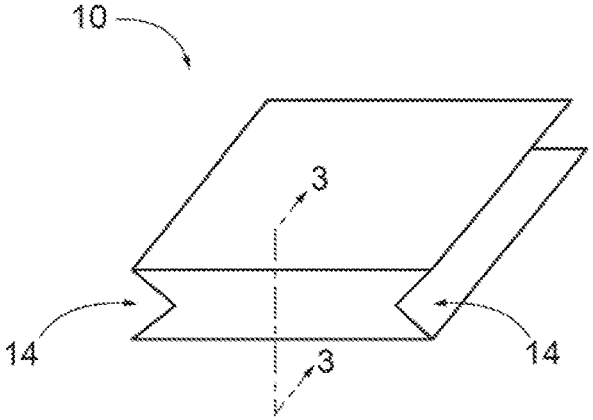
FIG. 2 is a perspective view of the beverage cooling device of FIG. 1 prior to activation.

Referring to FIG. 2, the beverage cooling device 10 is shown prior to activation. In one example, the housing 12 is structured with folds 14 on opposite side of the housing 12 allowing the beverage cooling device 10 to be provided in a flattened state. The flattened state of the beverage cooling device allows multiple devices to be shipped or stored in a reduced volume, thereby increasing the efficiency of transport and storage. In some embodiments, the beverage cooling device 10 is configured to expand in response to activation from the flattened state, such as shown in FIG. 2, to an expanded state, such as shown in FIG. 1. In some embodiments, the beverage cooling device has a thickness of no greater than 0.25 inches in at least one dimension when in the flatted state. Expansion of the beverage cooling device 10 may result from freezing of the activating agent upon reaction with the thermal agent.

Figure 3:
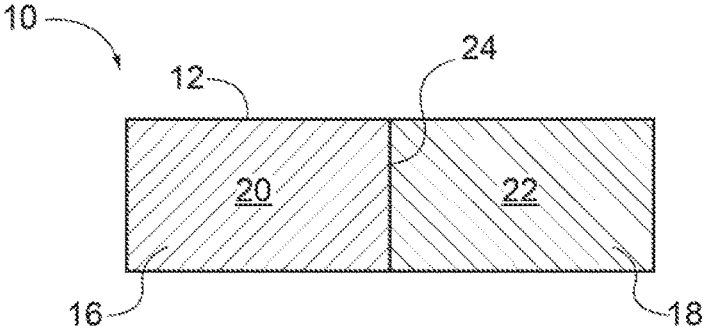
FIG. 3 is a cross-section of the beverage cooling device of FIG. 2.

Referring to FIG. 3, a cross-section of the beverage storage 10 is illustrated. As shown, the beverage storage device 10 includes a first chamber 16 that includes a thermal agent. To result in cooling of the beverage, the thermal agent is a cooling agent 20. The beverage cooling device also includes a second chamber 18 that includes an activating agent 22. The first chamber 16 and the second chamber 18 are separated by a barrier 24 that prevents the cooling agent from contacting the activating agent prior to activation of the beverage cooling device. The barrier 24 is further configured to be ruptured upon activation of the beverage cooling device such that the cooling agent and the activating agent come into contact with and react with each other in an endothermic reaction.

In one embodiment, the cooling agent is urea and the activating agent is water. Urea may be preferred as a cooling agent particularly due to its non-toxic nature. When the urea and water come into contact, an endothermic reaction occurs that causes the beverage cooling device to absorb heat and cool the surrounding beverage.

In other embodiments, the cooling agent may be ammonium nitrate, ammonium sulfamate, ammonium iodide, ammonium bromide, sodium chloride, sodium bicarbonate, potassium nitrate, potassium nitrite, methyl urea or combinations thereof. These chemical also produce endothermic reactions when combined with water, however as noted above urea may be preferred due to its non-toxic nature.

In embodiments of a beverage heating device, the thermal agent is a heating agent and may include one or more chemicals that when mixed or disrupted result in an exothermic reaction. In one example, the thermal agent may be a supersaturated solution of sodium acetate and the activating agent may be crystals that when released initiate nucleation which releases heat.

Referring again to the beverage cooling device 10, the barrier 24 maintains separation between the cooling agent 20 and the activating agent 22 until the beverage cooling device is activated. In this context, activation of the beverage cooling device may include physical manipulation of the beverage cooling device to break the barrier. As shown in FIG. 3, the barrier 24 may be secured to the interior surface of the housing 12. When the housing 12 is flexed, the barrier 24 may separate from the housing allowing, the activating agent 22 to contact the cooling agent 20 to begin the endothermic reaction. Alternatively, the activation process may include squeezing the housing 12 to compress either the first chamber 16 or the second chamber 18 until the contents of the chamber rupture the barrier 24. In any event, the barrier 24 is ruptured and the cooling agent and activating agent come into contact.

Figure 4:
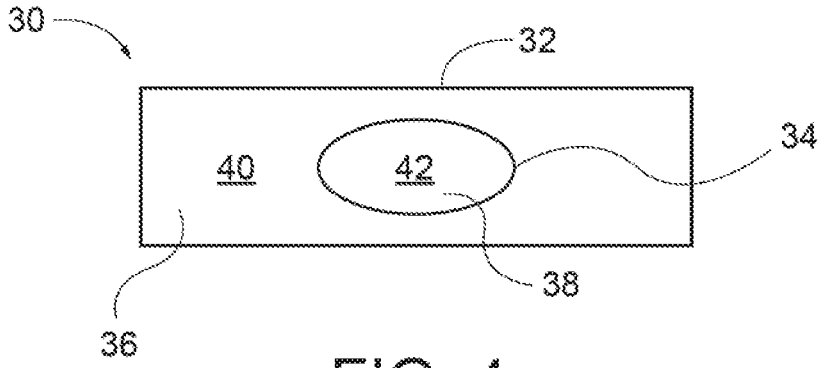
FIG. 4 is a cross-section of another embodiment of a beverage cooling device.

Referring now to FIG. 4, another embodiment of a beverage cooling device 30 is shown in cross-section. The beverage cooling device 30 has a housing 32 as previously discussed. In this embodiment, the beverage cooling device 30 has a first chamber 36 that includes cooling agent 40, and a second chamber 38 that includes activating agent 42. The second chamber 38 is within the first chamber 36, and the barrier 34 surrounds the second chamber 38. In this manner, the barrier 38 forms a second chamber housing. As discussed above, the beverage cooling device 30 may be activated by flexing or squeezing the housing 32 such that the barrier 34 ruptures and releases the activating agent 42 to contact the cooling agent 40. Although the second chamber is illustrated as generally oblong, it is contemplated that other shapes be used to define the second chamber. Moreover, in some embodiments, the first chamber containing the cooling agent may be within the second chamber, i.e. i.e. the first chamber and second chamber may be reversed compared to that illustrated in FIG. 4.

Figure 5:
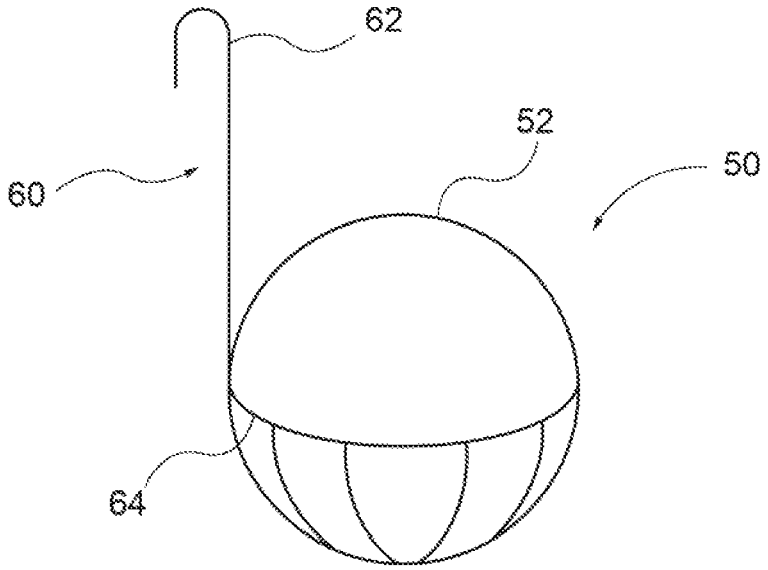
FIG. 5 is a perspective view of yet another embodiment of a beverage cooling device.

Referring now to FIG. 5, another embodiment of a beverage cooling device 50 is illustrated. The beverage cooling device 50 has a housing 52 which may have a generally spherical shape as shown. The beverage cooling device 50 includes a first chamber with a cooling agent and a second chamber containing an activating agent, that are separated by a barrier prior to activation. The barrier is configured to be ruptured to begin the endothermic reaction as previously discussed.

The beverage cooling device 50 also includes a container attachment 60 that is secured to the housing 52 and configured to affix the beverage cooling device to the rim of a glass or similar beverage container. In one embodiment, the container attachment 60 includes a hook 62 extending from the housing 52 configured to fit over the lip of glass, such as a wine glass. The container attachment 60 also includes a housing attachment portion 64 configured to secure the container attachment 60 to the housing. In some embodiments, the container attachment 60 may be permanently secured to the housing 52, while in other embodiments the container attachment is releaseably secured to the housing 52. Although the container attachment 60 is illustrated with a hook type attachment portion, other attachment device are also contemplated for use with the beverage cooling device. In one embodiment, the container attachment 60 includes a telescoping arm between the hook 62 and the housing attachment portion 64. The telescoping arm enables the container attachment to position the beverage cooling device 50 at a various depths within the container.

The disclosed beverage cooling device may be used to cool a beverage in a similar manner to an ice cube. The beverage cooling device however may be particularly well suited for use in beverage consumed outdoors away from a beverage preparation area. In one example, a consumer at a resort may order wine from a pool-side or beach bar. Due to the distance between the bar and the customer, the wine may increase in temperature during the time the wine is transported to the customer. This problem is exacerbated the hotter the ambient temperature and the further from the bar the customer is located. The disclosed beverage cooling device provides a solution to this problem by allowing the server or customer to activate the beverage cooling device once the beverage reaches the customer. The beverage can thus be cooled at the point of consumption, without the need to provide refrigeration or insulated or otherwise complicated drinking vessels. Moreover, the beverage cooling device does not dilute the beverage because the endothermic reaction occurs within the housing. The cooling agent and activating agent never mix with the beverage thus preserving the integrity of the beverage's taste and appearance. Similarly, a warm beverage may cool during transportation to the point of consumption, and a beverage heating device as disclosed may be used to heat the beverage at the point of consumption. In various embodiments, the beverage cooling or heating device may be well suited to use in hiking, camping, or other outdoor activities, to cool or heat a beverage as desired.

The beverage cooling device may include additional features to improve its utility for particular applications. In one embodiment, the beverage cooling device may include it flavor coating on the exterior surface of the housing. The favor coating may be, for example, a powder coating that is configured to dissolve into a beverage during use. In this manner, the beverage cooling device may also provide a flavor to the beverage. In another embodiment, the beverage cooling device may include an additive chamber configured to be ruptured to release an additive into the beverage. The additive chamber may contain a flavored additive, such as a fruit or citrus additive, or a tea or coffee flavor. In other embodiments, the additive chamber may contain an alcohol, such as gin or vodka, which may be released into the beverage. In this manner, the beverage cooling device allows for the preparation of flavored or alcoholic beverages at the point of consumption. The additive chamber may be ruptured through the use of a pull tab, or may have a valve for releasing the additive into the beverage.

The housing of the beverage cooling device is configured to prevent leakage of the cooling agent and activating agent into the beverage, however unintended leaks may occur. The use of urea as a cooling agent may be preferred due to its non-toxic nature in the event of an unintended leak into the beverage. In addition, the beverage cooling device may include a coloring agent disposed in either the first chamber or the second chamber that provides a visual indication in the event of a leak in the housing of the beverage cooling device. For example, an edible dye may be included in the activating agent, such that if the housing were to leak, the dye would become visible in the beverage allowing the customer to discontinue consumption if they so choose. In another embodiment, the beverage cooling device may include a a taste additive disposed in either the first chamber or the second chamber, that would provide a taste indication in the event of a leak in the housing of the beverage cooling device.

Embodiments of a beverage heating device are also contemplated substantially in the form of the beverage cooling devices disclosed above, but with the thermal agent being a heating agent rather than a cooling agent.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify any quantitative representation that could permissibly vary without resulting in a change in the basic function to which it is related. Moreover, unless specifically stated otherwise, any use of the terms "first," "second," etc., do not denote any order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

While certain embodiments have been described, it must be understood that various changes may be made and equivalents may be substituted without departing from the spirit or scope of the present disclosure. In addition, many modifications may be made to adapt a particular situation or material to the teachings of the disclosure without departing from its spirit or scope.

What is claimed is:

1. A device comprising:

a sealed housing configured to be placed into a beverage, the sealed housing having at least a pair of opposing sides that have folds configured to permit flattening of the sealed housing, the sealed housing defining an interior volume, a barrier attached to the sealed housing to partition the interior volume into a first chamber and a second chamber, the barrier having a first surface that faces the first chamber and a second surface that faces the second chamber, the first and second surfaces being oriented with the pair of opposing sides, a thermal agent disposed within the first chamber, an activating agent disposed within the second chamber for endothermically or exothermically reacting with the thermal agent, wherein the barrier is configured to keep the thermal agent separate from the activating agent, and is further configured to be ruptured upon activation of the device such that the thermal agent and activating agent come into contact with and react with each other.

2. The device of claim 1, wherein the thermal agent is a cooling agent.

3. The device of claim 2, wherein the cooling agent is urea and the activating agent is water.

4. The device of claim 3, wherein the housing comprises a low density polyethylene.

5. The device of claim 3, wherein the housing comprises a plant based biopolymer.

6. The device of claim 1 further comprising: a flavor coating on an exterior surface of the housing, wherein the flavor coating is configured to dissolve in a beverage during use.

7. The device of claim 3 further comprising: a flavor coating on an exterior surface of the housing, wherein the flavor coating is configured to dissolve in a beverage during use.

8. The device of claim 1 further comprising: a coloring agent within the sealed housing, wherein the coloring agent is configured to provide a visual indication in the event of a leak in the sealed housing.

9. The device of claim 3 further comprising: a coloring agent within the sealed housing, wherein the coloring agent is configured to provide a visual indication in the event of a leak in the sealed housing.

10. The device of claim 1 further comprising: a taste additive disposed within the sealed housing, wherein the taste additive is configured to provide a taste indication in the event of a leak in the sealed housing.

11. The device of claim 3 further comprising: a taste additive disposed within the sealed housing, wherein the taste additive is configured to provide a taste indication in the event of a leak in the sealed housing.

12. The device of claim 1, wherein the second chamber is within the first chamber.

13. The device of claim 1, wherein the barrier is secured to an interior surface of the housing, and is configured to be ruptured when the housing is flexed.

14. The device of claim 1, wherein the barrier is a second chamber housing and is configured to be ruptured when the housing is squeezed.

15. The device of claim 1, wherein the sealed housing is configured to expand upon activation of the thermal agent and the activating agent.

16. The device of claim 1, wherein, prior to activation, the sealed housing has a thickness of no greater than 0.25 inches in at least one dimension.

17. The device of claim 1 further comprising: a hook extending from the housing to affix the device to the rim of a container.

18. The device of claim 1, wherein the thermal agent is a heating agent.

19. The device of claim 18, wherein the heating agent is a supersaturated solution of sodium acetate.

* * * * *